US006766798B2

(12) United States Patent
Herres et al.

(10) Patent No.: US 6,766,798 B2
(45) Date of Patent: Jul. 27, 2004

(54) SUPPLEMENTAL AIR DIRECTING EXTENSION FRAME FOR A FIREPLACE

(76) Inventors: Schuyler Herres, 6614 Seneca Dr., Columbia, MD (US) 21046; Jac E. Knust, 724 Athlone Dr., Bel Air, MD (US) 21014

( * ) Notice: Subject to any disclaimer, the term of this patent is extended or adjusted under 35 U.S.C. 154(b) by 99 days.

(21) Appl. No.: 10/112,742

(22) Filed: Apr. 2, 2002

(65) Prior Publication Data

US 2003/0183220 A1 Oct. 2, 2003

(51) Int. Cl.[7] ..... F24B 1/189; F24B 1/188
(52) U.S. Cl. ..... 126/521; 126/527
(58) Field of Search ..... 126/521, 527, 126/516, 525

(56) References Cited

U.S. PATENT DOCUMENTS

| | | | | |
|---|---|---|---|---|
| 1,609,693 A | | 12/1926 | Cesa | |
| 2,497,486 A | | 2/1950 | Barber | |
| 3,180,332 A | | 4/1965 | Grushkin | |
| 4,091,794 A | * | 5/1978 | Stites | 126/524 |
| 4,108,144 A | | 8/1978 | Wilhoite | |
| 4,137,895 A | | 2/1979 | Bittinger | |
| 4,142,507 A | | 3/1979 | Stanko | |
| 4,190,034 A | | 2/1980 | Wonisch | |
| 4,240,403 A | * | 12/1980 | Bader | 126/549 |
| 4,282,855 A | * | 8/1981 | Perry | 126/521 |
| 4,301,783 A | * | 11/1981 | Buckner et al. | 126/521 |
| 4,357,930 A | * | 11/1982 | Eberhardt | 126/515 |
| 4,372,288 A | | 2/1983 | Nicholas | |
| 4,446,848 A | * | 5/1984 | Becker et al. | 126/521 |
| 4,470,400 A | | 9/1984 | Fleisler | |
| 4,471,756 A | | 9/1984 | Eberhardt | |
| 4,810,173 A | | 3/1989 | Thomson et al. | |
| 4,829,914 A | | 5/1989 | Boucher | |
| 5,148,798 A | | 9/1992 | de Kock | |
| 5,224,650 A | | 7/1993 | Gozikowski | |
| 5,460,162 A | | 10/1995 | Binzer | |
| 5,979,437 A | | 11/1999 | Eberhardt | |

* cited by examiner

*Primary Examiner*—Alfred Basichas
(74) *Attorney, Agent, or Firm*—Rosenberg, Klein & Lee

(57) ABSTRACT

A supplemental air directing frame for a fireplace (10) is provided where frame (10) includes an upper channel (12), a pair of sidewalls (14) and a pair of front panels (16). Upper channel (12) has an air flow opening formed therethrough and air is directed through the air flow opening into nozzle (32), where it is directed towards combustible material (48) within fireplace (24). A variably controlled fan (26) draws exterior air into upper channel (12). The fan (26) is controlled by a rheostat (28) so that a user may variably control the rate of air directed into combustion chamber (24), thus controlling the rate of combustion of the combustible material (48).

20 Claims, 6 Drawing Sheets

SUPPLEMENTAL AIR DIRECTING EXTENSION FRAME FOR A FIREPLACE

BACKGROUND OF THE INVENTION

1. Field of the Invention

The subject invention relates to a supplemental air directing frame system adapted to be mounted to a commercial or domestic fireplace to serve as an extension module for maximizing the combustion of logs or other combustible material within the fireplace. The supplemental air directing extension frame of the subject invention extends between the front opening of the fireplace and a glass door firescreen, both standardly dimensioned to serve as a module for maximizing the combustion of logs, firewood, or other combustible material within the fireplace. In particular, the present invention directs itself to a frame system mounted adjacent and abutting a standardly dimensioned fireplace. The frame system has an upper channel open on one end and closed at an opposing end. More particularly, the frame system includes an upper channel having an air flow opening formed therethrough with the air flow opening allowing air to flow from the upper channel into a nozzle which directs the air flow into the fireplace for increasing the rate of combustion of combustible materials within the fireplace.

Further, a fan is mounted on the open end of the upper channel to direct air from the exterior environment into the upper channel and through the nozzle. The fan is in electrical communication with a rheostat allowing for variable control of the power output of the fan, thus allowing a user to selectively control the rate of combustion of the combustible materials within the fireplace.

Additionally, this invention directs itself to a supplemental air directing frame system having two exterior side walls. Each of the exterior side walls defines an insulating passageway for receiving thermally insulating fire bricks. The thermally insulating fire bricks act to both inhibit thermal conduction of the heat generated by the fire, and also serve to store heat generated by the fire to be radiated into the environment. Further, the pair of exterior sidewalls are formed of heat conductive material for heating the exterior environment, and also act to support an upper wall of the frame system.

Still further, this invention relates to an air directional mechanism for specifically directing air under pressure to logs or other combustible material positioned in a fireplace to enhance heat transport characteristics of the logs being burned.

Additionally, this invention relates to an air directional mechanism which provides air to be directed from above the logs mounted in the fireplace where the air path is inclined in a downward direction from the front of the fireplace to a grate holding the logs.

This invention relates to a supplemental air frame which is modular in design and is adapted to be interfaced with standard fireplace units having the ability of maximizing the combustion effects of combustible materials, wherein even logs which are classified as green wood and/or wet or damp logs are substantially completely combusted.

2. Prior Art

Supplemental air fans for household fireplaces are known in the art. In general, such prior art systems include a fan mounted on the outside of a fireplace for directing air onto the fire. In many instances, the problems of such prior art supplemental fireplace systems are that the fans are not variably controlled to allow a user to selectively control the rate of combustion. Further, the prior art fireplace systems generally are not modular in construction and do not include passageways for receiving insulating bricks. Additionally, and most importantly, prior art air directing systems for fireplaces do not direct the air flow directly onto the combustible material. Direct flow of the air onto the combustible material greatly increases the rate of combustion and also allows for the drying and subsequent burning of green or wet wood.

One such prior art fireplace system is shown in U.S. Pat. No. 3,180,332. This reference is directed to a metal fireplace structure with air supply means for a combustion chamber. This system utilizes duct work to supply outside air, from outside of the building, to the combustion chamber of a fireplace. A blower may be utilized to increase the rate of air drawn into the chamber. This system, however, does not direct the air onto the combustible materials. It merely directs the air into the combustion chamber. Additionally, the fireplace system does not include a thermal reflector for directing infrared radiation generated by the fire into the household.

Another such prior art fireplace system is shown in U.S. Pat. No. 4,471,756. This reference is directed to an air supply distributor for fireplaces. This system provides a means for supplying relatively cold air to a hearth opening, the means comprising an air intake vent through which outside air may flow into the ash pit for flow therefrom through the hearth opening to supply air for the combustion of the fire in the fireplace. This system blows air from beneath the hearth and under the fire into the combustion chamber. It also utilizes a source of cold, outside air rather than the warm and dry air found within the home.

U.S. Pat. No. 4,470,400 is directed to a fireplace insert. This system includes a pair of side heating channels with associated fans for heating and expelling drawn air back into the room. It does not, however, include a system for directing air onto the fire for increasing the rate of combustion.

U.S. Pat. No. 4,372,288 is directed to an outside combustion air unit for a masonry fireplace. This system draws air through a pair of inlet ducts from an external environment into the fireplace. It does not, however, direct the air stream onto the fire from above for controlling combustion, nor does it include a fan system for controlling the rate of air flow. Further, this system does not include a thermal reflector for directing and reflecting infrared radiation into the household.

Another prior art fireplace system is shown in U.S. Pat. No. 2,497,486. This reference is directed to a fireplace with supplemental draft means. This system utilizes a fan to draw air from an exterior of the building into the combustion chamber of the fireplace. The air flows underneath the fire. This system does not have a means for directing the air directly onto the fire from above.

None of the prior art provides for a combination of elements forming a supplemental air directing frame for a fireplace which directs air from inside the room directly onto the fire from above. Additionally, none of the prior art Patents provide for a means for controlling the rate of air directed onto the fire, thus allowing a user to variably control the rate of combustion within the fireplace.

SUMMARY OF THE INVENTION

The present invention provides for a supplemental air directing frame system for a fireplace. The frame system is mounted around the outside of the main combustion chamber of the fireplace and directs air, drawn from within the room, onto the combustible materials and the fire itself. The frame includes an upper channel and two side walls. The upper channel has an open end, a closed end, and an air directing passage formed through a bottom wall thereof. A fan is mounted on the open end of the upper channel, drawing and directing air from the room through the upper channel, where it is directed by a nozzle affixed to the air directing opening onto the fire within the combustion chamber of the fireplace.

Additionally, each of the side walls houses a stack of thermally insulating fire bricks or other thermal insulation material. The fire bricks act as both thermal insulation to prevent the extension frame from becoming dangerously hot due to the heat generated by the fire. Additionally, the fire bricks store the heat generated by the fire to be radiated throughout the time that the fire burns within the fireplace, and long after. The supplemental air directing frame system is generally constructed from sheet metal or another thermally conducting material. The stacks of thermally insulating cement bricks positioned adjacent the side walls of the air directing frame prevent the side walls from becoming dangerously hot. The stacks of bricks further act to direct and focus the heat of the fire, transferred by both infrared radiation and thermal convection, through the main front opening of the supplemental air directing frame.

It is a principle object of the subject supplemental air directing frame system to provide a frame structure which is adapted to be mounted about or around the periphery of a fireplace.

It is a further objective of the subject supplemental air directing frame for a fireplace to provide a frame structure having an open upper channel formed therein.

It is a further objective of the subject invention to provide a fan for drawing and directing external air into the upper channel of the supplemental frame system, the air being directed through a nozzle projecting downwardly from the upper channel onto combustible materials positioned in the fireplace.

It is an objective of the subject invention to provide a quiet and non-intrusive means for blowing air into the fireplace.

It is a further objective of the subject supplemental air directing extension frame to provide a fan utilizing a low voltage DC motor.

It is a further objective of the subject invention concept to provide a supplemental air directing frame system having a pair of side walls, each of the side walls defining a passage for housing a stack of thermally insulating bricks.

It is an important objective of the present invention to provide a rheostat in electrical communication with the fan allowing a user to variably control the rate of air flow within the combustion chamber of the fireplace. Variable control of the fan and subsequent control over the rate of air flow allows for control over the rate of combustion of the combustible materials.

It is an important objective of the present invention to provide a means for holding the combustible materials.

It is a further important objective of the present invention to provide an air directing nozzle for directing an air stream directly onto the combustible material inside the fireplace in order to increase the rate of combustion and allow for the burning and drying of green or wet wood.

DESCRIPTION OF THE PREFERRED EMBODIMENT

Figure 1:
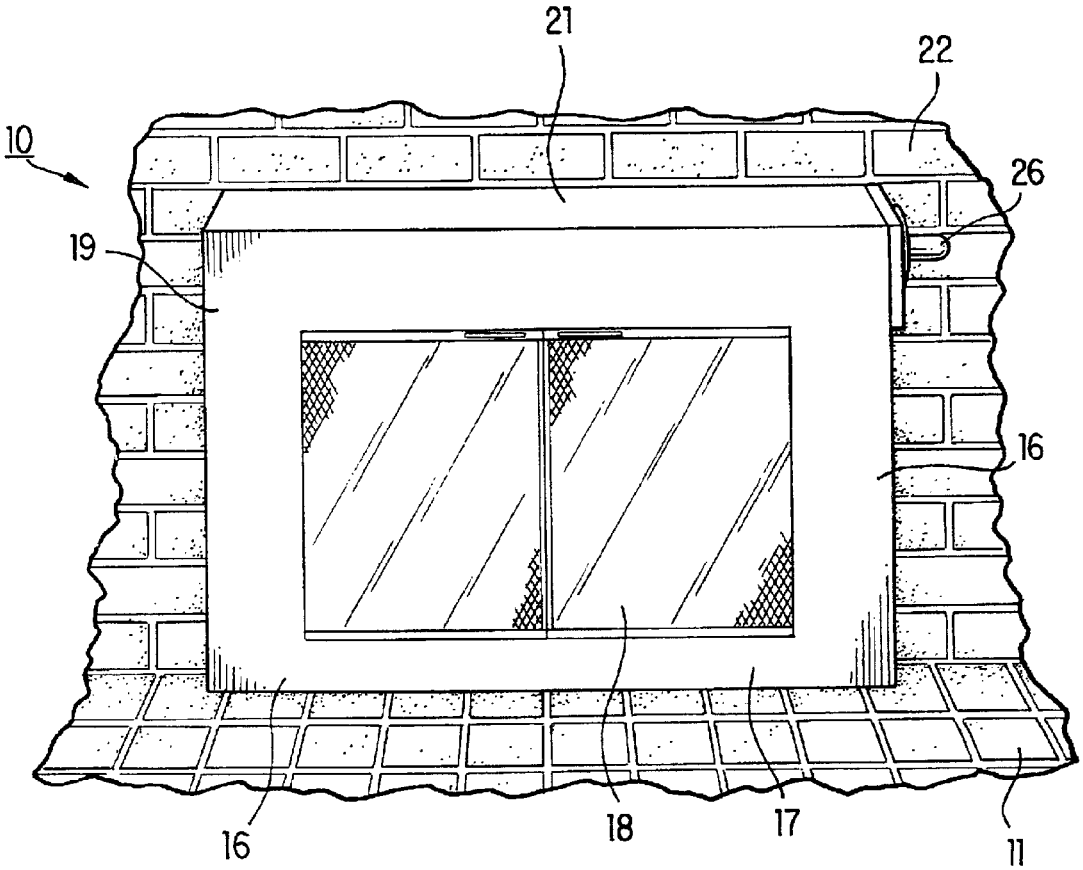
FIG. 1 is a front view of the subject supplemental air directing frame system for a fireplace mounted to a wall.
Figure 2:
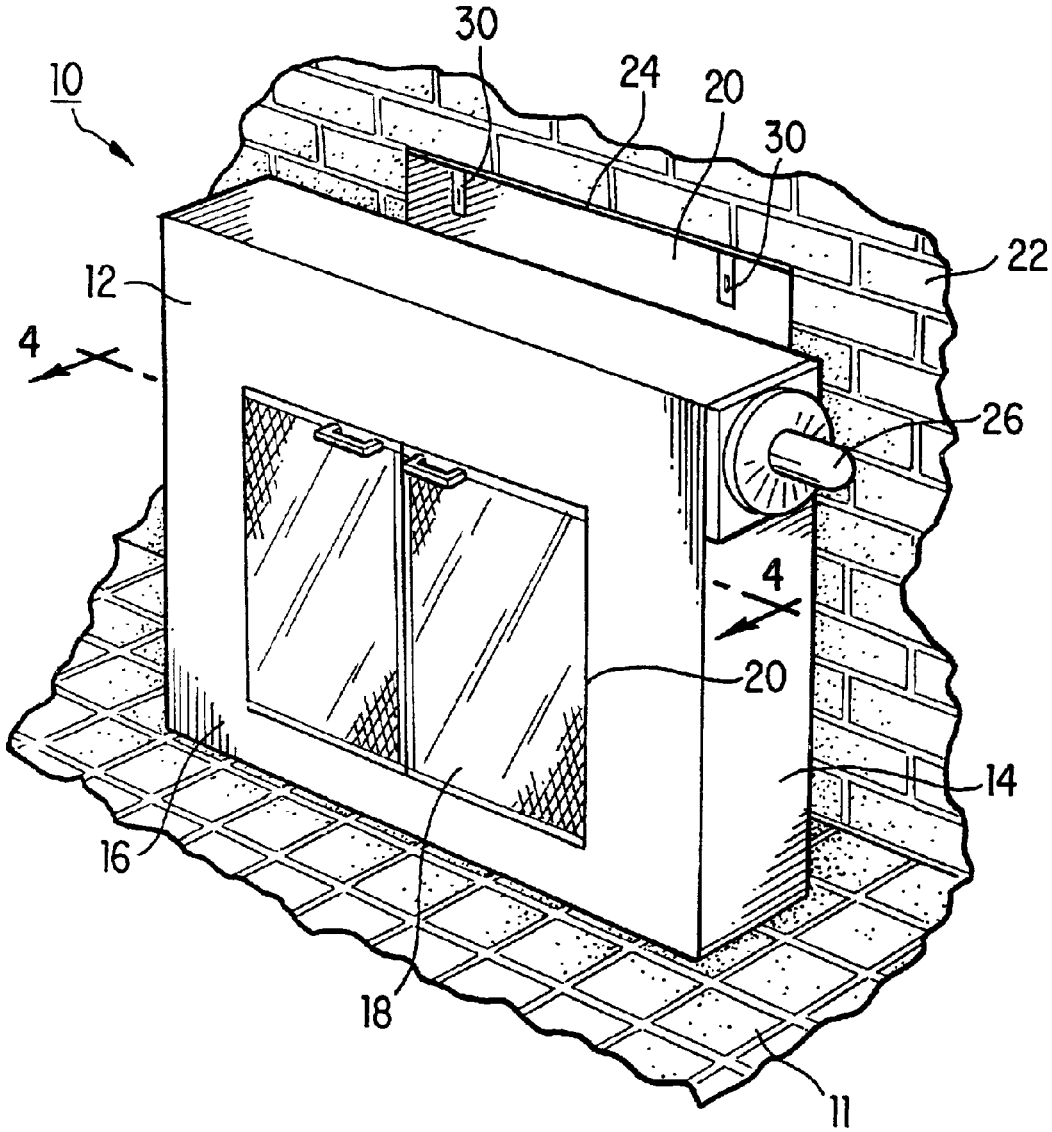
FIG. 2 is a perspective view of the supplemental air directing frame system spaced apart from the wall and fireplace.

Referring to FIGS. 1 and 2, there is shown a supplemental air directing frame system 10 adapted to be mounted adjacent and abutting a commercial or domestic fireplace. As shown in FIG. 1, supplemental air directing frame system 10 is mounted adjacent a fireplace unit wall 22 and rests on fireplace extension floor member 11. The fireplace unit may be of standard size for household units or customized to the user's needs. In overall concept, it is not important to the inventive concept as to the particular dimensions of frame system 10 with the exception that frame system 10 in contour be adaptable to the contour of opening 20 formed within the fireplace.

Frame system 10 is adapted to be mounted adjacent and in abutting relation with wall member 22 to provide a frontal enclosure to fireplace opening 20. In this manner, frame system 10 forms a modular unit which may be mounted or secured to wall 22, as is clearly seen in FIG. 1.

As shown in FIG. 1, frame system 10 includes a pair of vertically directed front panels 16 formed in integral relation with lower panel 17 and upper panel 19. Mounted between opposing front panels 16 and lower panel 17 and upper panel 19 are door members 18. Door members 18 may be rotated about a vertical axis to allow access to the interior of the fireplace. The combination of the horizontally directed upper panel 19, front panels 16, and lower horizontally directed panel 17 forms an opening wherein doors 18 may be mounted.

Frame system 10 includes upper horizontally directed wall member 21 formed in generally orthogonal relation with side panels 16, upper panel 19 and lower panel 17.

The overall cross-sectional contour of frame system 10 is generally rectangular, however, the specific contour is not important to the inventive concept as herein described with the exception that it be mounted adjacent and abutting wall 22 and further covers opening 20 of the fireplace.

Figure 4:
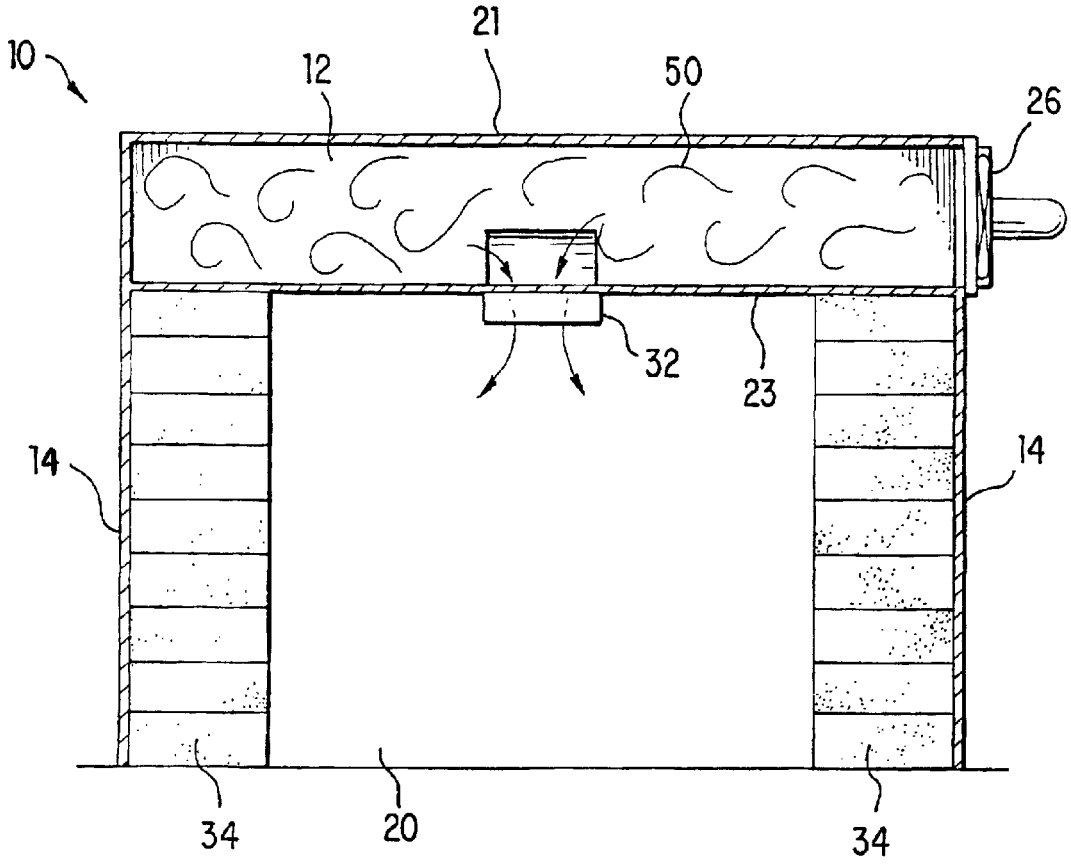
FIG. 4 is a sectional view of the supplemental air directing frame system.

As is more clearly seen in FIG. 4, opposing front panels 16 are formed in one-piece construction with sidewalls 14 to form an enclosure where bricks or other insulating material 34 may be mounted and which will be further described in following paragraphs. Upper wall member 21 in combination with an upper section lower wall 23 form flow chamber 12 therein, as is seen in FIG. 4. Door members 18 may be fixed to vertically directed panel members 16 by hinges or other rotational mechanisms. Doors 18 may be formed of some type of heat resistant glass or other suitable material. Heat resistant glass doors for fireplace enclosures are well-known in the art. One set of glass doors which are commercially available may be purchased from Summit Fireplace Co., Inc. of Harwich, Mass.

Structural materials forming the frame system 10 may be formed of a metal or other suitably thermally conductive material such as brass, bronze, or other like material. Thus, the structural components for vertically directed and opposing panels 16, upper and lower panels 19 and 17, as well as upper wall 21 and upper section lower wall 23 may be formed of such metal compositions. In some cases, thermal frame system 10 may be formed of thermally insulating compositions to reduce thermal transport through the structural members forming frame system 10.

Frame system 10 is generally mounted in fixed coupling relation to surrounding fireplace wall 22. Frame system 10 may be mounted to surrounding wall 22 through a plurality of bracket members 30 seen in FIG. 2. In this manner, frame system 10 may be fixedly secured to the surrounding wall 22 of fireplace 24. Frame system 10 may be attached to brackets 30 by threaded members or any other suitable fixing mechanism not important to the inventive concept as herein defined, with the exception that the fixing or coupling mechanism permits frame system 10 to be fixedly coupled to surrounding wall 22.

Figure 3:
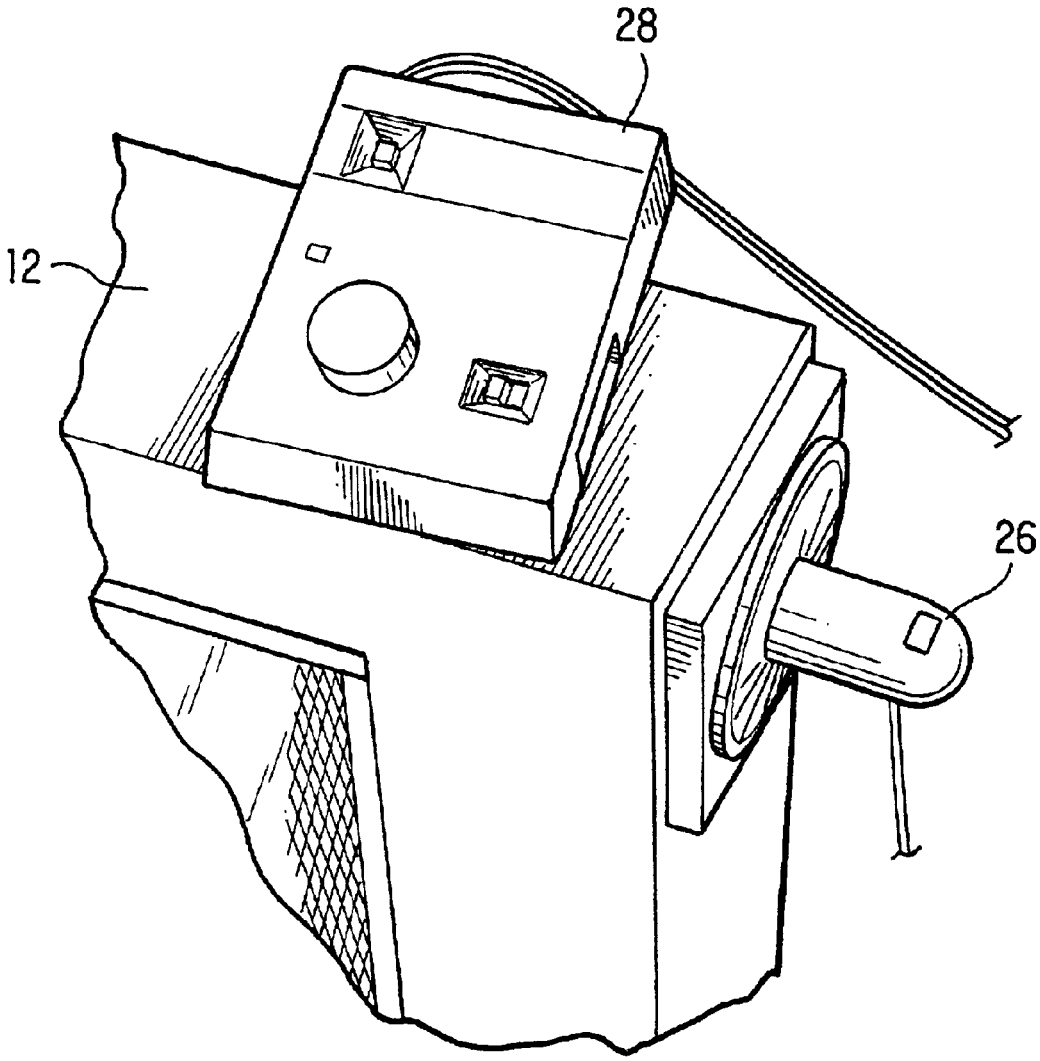
FIG. 3 is a partial perspective view of the supplemental air directing frame system showing a variably controlled fan fixed to an upper channel of the air directing frame.
Figure 6:
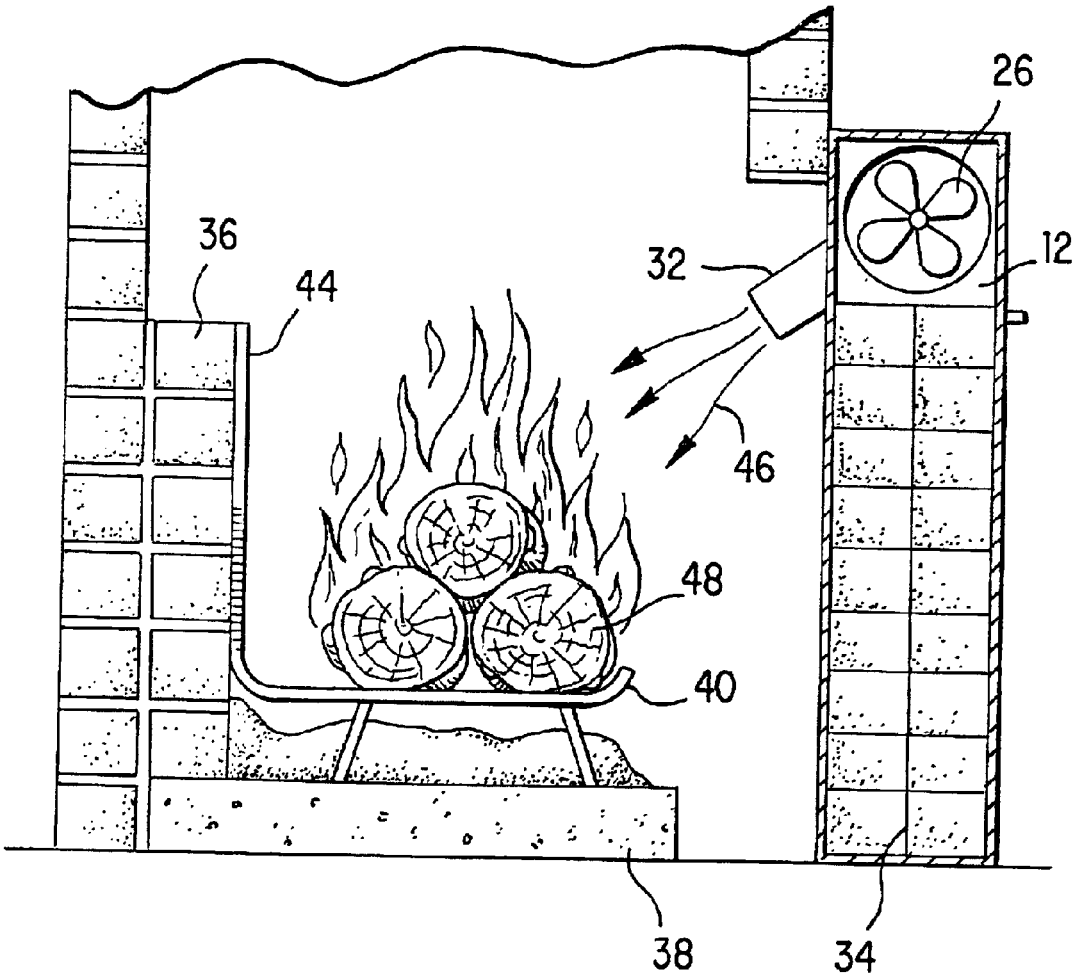

Referring now to FIGS. 2 and 3, there is seen blowing mechanism or fan 26 which is affixed to one vertically directed sidewall member 14 for directing air from a room within which the fireplace 24 is located into upper channel 12. As shown in FIGS. 4 and 6, air stream 50 is produced by actuation of fan member 26 and passes in a generally horizontal manner through upper channel 12.

Fan 26 may be any commercially purchasable fan member which allows for control as will be seen in following paragraphs. Fan 26 provides for a stream of air 50 to be directed through channel 12 which is intersected by nozzle 32 as is seen in FIGS. 4 and 6. The flow of air may be controlled at the user's discretion through rheostat 28 shown in FIG. 3 or any other variable controller. Rheostat 28 is electrically coupled to fan 26 and permits variable control of the power output of fan 26 which then determines the pressure drop within channel 12. A user may control the rate of air flow 50 and the air stream 46, shown in FIG. 6, to control the rate of combustion of combustible materials 48 mounted within fireplace 24. Rheostat 28 is electrically coupled to a source of electrical power (not shown and not important to the inventive concept as herein described).

Fan 26 may have either a DC or AC electric motor. It is, however, preferable for the fan 26 to be quiet, non-intrusive, and utilize a safe low-voltage power source. Although AC fans may be used, low voltage, variable speed, safe DC fans, such as the type used to cool the interior of motor vehicles, are preferred. Such fans may be backed-up with rechargeable 6 or 12-volt batteries.

Referring now to nozzle 32 shown in FIGS. 4 and 6, such is mounted to lower wall member 23 forming a lower surface of channel 12. Nozzle 32, as is seen in FIG. 6 is generally mounted in an inclined manner to the frame sections forming channel 12 to provide the air stream flow 46 directly onto the combustible material 48 mounted within the fireplace. The air directed onto combustible material or logs 48 increases the rate of combustion and thus allows for combustion of wet or green wood in a maximized combustion setting. Opposing vertically directed front wall members 16 in combination with side walls 14 form insulating passageways for receiving insulating materials, which may be in the form of stacks of bricks 34, as is shown. The bricks or other insulating material 34 prevent side walls 14 and front panels 16 from becoming overheated. In some cases, as has previously been discussed, side walls 16 as well as other structural members such as lower horizontally directed wall 17 and upper horizontally directed wall 19 may become heated to a dangerous extent, possibly creating a fire hazard due to increased thermal conduction. With the insulating bricks 34 mounted therein, a dangerous rise in temperature of the structural members of frame system 10 is prevented. Still further, the stack of insulating bricks 34 may act to direct the heat generated by the fire within the fireplace 24 in the form of infrared radiation and thermal convection currents through the opening in the air directing frame system 10 (through the heat resistant doors 18 into the room of the household).

Bricks 34 may be standard fire bricks. The fire bricks 34 act to insulate the thermally conductive frame from the great amounts of heat generated by the fire. Additionally, fire bricks 34 act to store thermal energy in order to be radiated to the external environment both while the fire is still burning inside the fireplace and long after.

Figure 5:
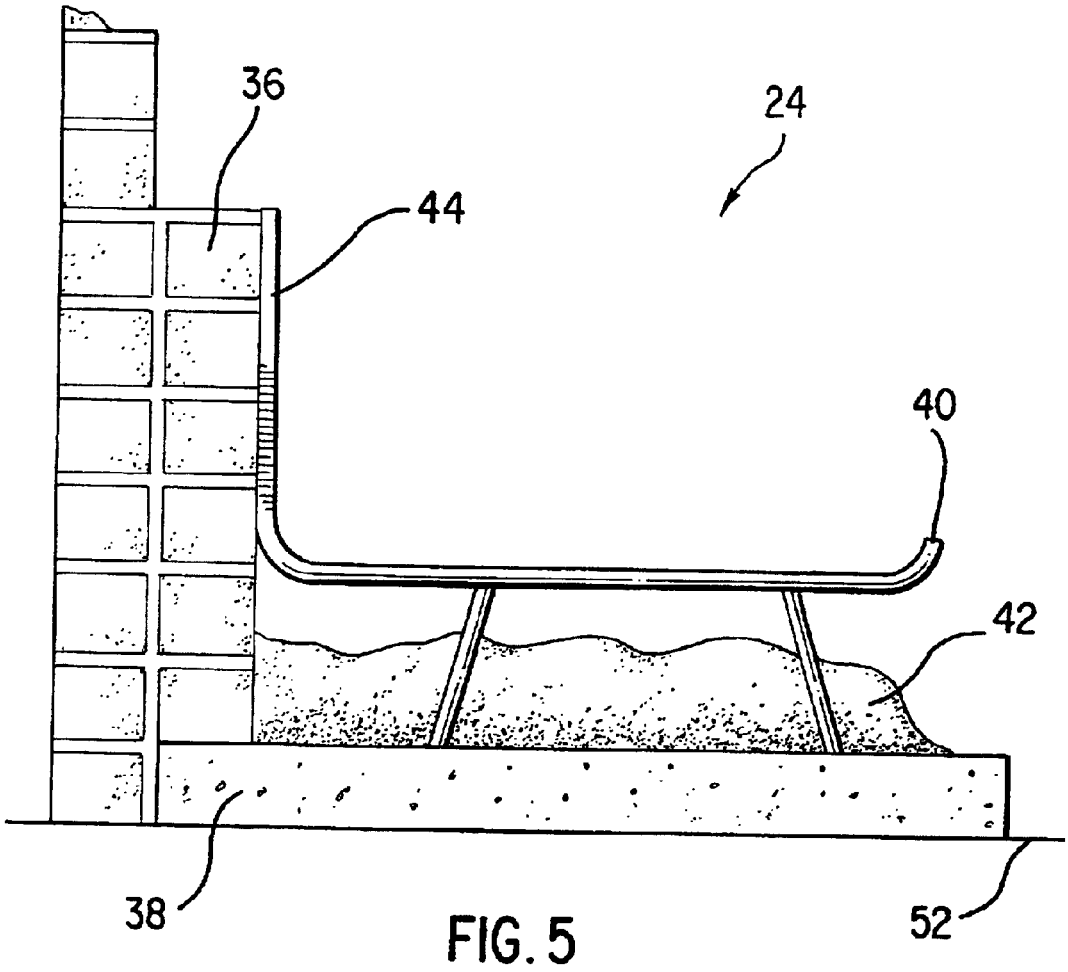
FIG. 5 is a cut-away side view of the grate mounted in the fireplace taken along the section line 4—4 of FIG. 2; and, FIG. 6 is a cut-away side view of the supplemental air directing frame system mounted on the fireplace.

FIG. 5 is a partially cut-away side view of the interior of fireplace 24. A grate 40 is positionally located within fireplace 24 for receipt of logs or other combustible materials 48. Hearth 52 of fireplace 24 is protected from damage by a layer of cement bricks or other thermally insulating material 38. Grate 40 is mounted on brick layer 38 in a vertically displaced positional location to permit a layer of ash 42 to be formed beneath the mounted logs 48 during the combustion process. The grate 40 may be formed of some type of heat resistant metallic composition which is well-known in the art and not important to the inventive concept as herein discussed. The layer of ash 42 thus formed acts as both a barrier to block the flow of air underneath the grate 40, as well as a thermal insulator for insulating the fireplace unit.

As is seen in FIG. 5, grate 40 includes a thermal reflector 44 which may be formed of a metallic member having a high reflectivity. The thermal reflector 44 may be constructed of a metal material or other suitable infrared radiation reflecting composition. During combustion, combustible materials 48 generate heat in the form of infrared radiation and thermal convection currents. Infrared radiation is then reflected and directed by thermal reflector 44 through heat resistant doors 18 of frame system 10. In this manner, a greater percentage of the heat generated by the fire is directed into the room surrounding the fireplace and the external environment than would ordinarily be generated by a typical or prior art fireplace system.

An additional stack of bricks or other thermally insulative material 36 may be positioned behind the grate 40 and metal reflector 44, as is seen in FIGS. 5 and 6. This additional insulating set of bricks 36 may prevent thermal damage to the walls of the structure of the edifice within which the fireplace is formed.

In an alternative embodiment, combustible materials 48 would be mounted within fireplace 24 without the use of a grate member. The combustible materials, or logs, 48 would be mounted directly on the layer of ash 42. The layer of ash 42 would act as both a thermal insulator and also prevent air currents from forming beneath combustible materials 48 when combustible materials 48 were combusting. The prevention of under-currents would increase the amount of heat transmitted to the external environment through convection currents.

In the alternative embodiment where combustible materials 48 are mounted within fireplace 24 without the use of a grate member, the fireplace acts to simulate an outdoor bonfire. As opposed to the inefficient placement of logs or other combustible material within a regular fireplace, the positioning of combustible material 48 on top of a layer of ash allows for a long-lasting combustible state. The removal of under-currents maintains combustion within the combustible materials which may be rekindled at any time through the application of minor air currents, such as those provided by fan 26.

Returning to FIG. 6, air stream 50 of FIG. 4 is directed from internal upper channel 12 through nozzle 32 to form directed air stream 46. Directed air stream 46 is angled to allow air to be blown or otherwise displaced directly onto combustible materials 48 from above. As has been stated, utilization of air stream 46 increases the rate of combustion of combustible materials 48 and aids in the drying and combustion of wet and green wood to provide a maximizing efficiency of the combustion process. In this manner, logs 48 or other combustible material may be provided with an increased combustion rate or even a lower combustion rate, dependent upon the particular desires of a user at a specified time. In this manner, the user has within his or her control the amount of heat being radiated and/or convected from the fireplace into the room of the edifice.

Although this invention has been described in connection with specific forms and embodiments thereof, it will be appreciated that various modifications other than those discussed above may be resorted to without departing from the spirit or scope of the invention. For example, functionally equivalent elements may be substituted for those specifically shown and described without departing from the spirit or scope of the invention as defined in the appended claims.

What is claimed is:

1. A supplemental air directing frame for a fireplace comprising:

a combustion chamber having a front opening and a hearth;

means for supporting solid combustible products in said combustion chamber, said solid combustible products being positioned in spaced relation to said hearth;

a mountable frame having an upper channel and a pair of opposed side walls, said mountable frame being mounted on a periphery of said front opening of said combustion chamber, said upper channel having a closed end and an open end, said closed end and said open end being longitudinally opposed to one another, said upper channel defining a front wall and a rear wall, said rear wall having an air flow opening formed therethrough;

an externally powered fan fixed to said open end of said upper channel for drawing air from an external environment into said upper channel, said externally powered fan having a variable power output; and, a nozzle fixedly secured to said rear wall of said upper channel about said air flow opening, said nozzle projecting into said combustion chamber and directing said air from said upper channel directly onto said solid combustible products for increasing available combustible oxygen for combustion of said solid combustible products.

2. The supplemental air directing frame for a fireplace as recited in claim 1, wherein said mountable frame is formed of a thermally conductive material.

3. The supplemental air directing frame for a fireplace as recited in claim 1, wherein said mountable frame receives a pair of doors for covering said front opening of said combustion chamber.

4. The supplemental air directing frame for a fireplace as recited in claim 1, wherein said means for supporting solid combustible products has a thermal reflector projecting therefrom for directing radiant heat into said external environment.

5. The supplemental air directing frame for a fireplace as recited in claim 1, wherein said externally powered fan is in electrical communication with a rheostat for controlling power output of said externally powered fan.

6. The supplemental air directing frame for a fireplace as recited in claim 1, wherein an insulating layer of ash is formed between said means for supporting solid combustible products in said combustion chamber and said hearth.

7. The supplemental air directing frame for a fireplace as recited in claim 1, wherein said upper channel has a substantially rectangular cross-section.

8. The supplemental air directing frame for a fireplace as recited in claim 1, wherein each of said side walls defines a passage for receiving a stack of thermally insulating bricks.

9. The supplemental air directing frame for a fireplace as recited in claim 1, wherein an insulating layer of brick is formed between said hearth and said means for supporting solid combustible products.

10. The supplemental air directing frame for a fireplace as recited in claim 1, wherein said externally powered fan is in electrical communication with a power source.

11. The supplemental air directing frame for a fireplace as recited in claim 1, wherein an insulating layer of ash is formed between said means for supporting solid combustible products and said hearth.

12. A supplemental air directing frame for a fireplace comprising:

a combustion chamber having a front opening and a hearth;

means for supporting solid combustible products in said combustion chamber, said solid combustible products being positioned in spaced relation to said hearth, said means for supporting solid combustible products having a thermal reflector mounted thereon for reflecting and directing infrared radiation generated by combustion of said solid combustible products;

a mountable frame having an upper channel and a pair of opposed side walls, said mountable frame being mounted on a periphery of said front opening of said combustion chamber, said upper channel having a closed end and an open end, said closed end and said open end being longitudinally opposed to one another, said upper channel defining a front wall and a rear wall, said rear wall having an air flow opening formed therethrough;

an externally powered fan fixed to said open end of said upper channel for drawing air from an external environment into said upper channel, said externally powered fan having a variable power output and, a nozzle fixedly secured to said rear wall of said upper channel about said air flow opening, said nozzle projecting into said combustion chamber and directing said air from said upper channel directly onto said solid combustible products for increasing available combustible oxygen for combustion of said solid combustible products.

13. The supplemental air directing frame for a fireplace as recited in claim 12, wherein said mountable frame is formed of a thermally conductive material.

14. The supplemental air directing frame for a fireplace as recited in claim 12, wherein said mountable frame receives a pair of doors for covering said front opening of said combustion chamber.

15. The supplemental air directing frame for a fireplace as recited in claim 14, wherein each of said doors is formed from glass.

16. The supplemental air directing frame for a fireplace as recited in claim 12, wherein said externally powered fan is in electrical communication with a rheostat for controlling power output of said externally powered fan.

17. The supplemental air directing frame for a fireplace as recited in claim 12, wherein said upper channel has a substantially rectangular cross-section.

18. The supplemental air directing frame for a fireplace as recited in claim 12, wherein each of said side walls forms a passage for receiving a stack of thermally insulating bricks.

19. The supplemental air directing frame for a fireplace as recited in claim 12, wherein a thermally insulating layer of brick is formed between said means for supporting solid combustible products and said hearth.

20. The supplemental air directing frame for a fireplace as recited in claim 12, wherein said externally powered fan is in electrical communication with a power source.

* * * * *